US006190515B1

(12) United States Patent
Prior

(10) Patent No.: US 6,190,515 B1
(45) Date of Patent: Feb. 20, 2001

(54) SILVER REFINING INSTALLATION

(75) Inventor: Adalbert Prior, Goetzis (AT)

(73) Assignee: Prior Engineering AG, Zurich (CH)

( * ) Notice: Under 35 U.S.C. 154(b), the term of this patent shall be extended for 0 days.

(21) Appl. No.: 09/341,215

(22) PCT Filed: Nov. 6, 1998

(86) PCT No.: PCT/AT98/00273

§ 371 Date: Sep. 30, 1999

§ 102(e) Date: Sep. 30, 1999

(87) PCT Pub. No.: WO99/24646

PCT Pub. Date: May 20, 1999

(30) Foreign Application Priority Data

Nov. 6, 1997 (AT) ..... 694/97 U

(51) Int. Cl.[7] ..... C25D 7/00

(52) U.S. Cl. ..... 204/222; 204/227; 204/269

(58) Field of Search ..... 204/222, 227, 204/269, 275.1

(56) References Cited

U.S. PATENT DOCUMENTS

| | | | | |
|---|---|---|---|---|
| 4,054,503 | * | 10/1977 | Higgins | 204/271 |
| 4,090,935 | * | 5/1978 | Dunning, Jr. et al. | 204/146 |
| 4,257,864 | * | 3/1981 | Gacki | 204/213 |
| 4,670,115 | * | 6/1987 | Prior et al. | 204/109 |
| 4,728,402 | * | 3/1988 | Prior | 204/109 |
| 5,100,528 | * | 3/1992 | Claessens et al. | 204/212 |

* cited by examiner

*Primary Examiner*—Kathryn Gorgos
*Assistant Examiner*—Erica Smith-Hicks
(74) *Attorney, Agent, or Firm*—Townsend and Townsend and Crew LLP

(57) ABSTRACT

The invention concerns a silver refining installation operating according to the Moebius method and designed for treating particulate raw silver. The anodes contain a section for receiving the raw silver, an underlying section for receiving anodic slime and, inserted between these two sections a support permeable to anodic slime and designed for the raw silver overflow. The support has at least two mutually mobile conveying elements with horizontal axes extending substantially over the support length and between which a slot allows the anodic slime to pass through. The invention is characterized in that the conveying elements have a reciprocating motion in the axial direction.

6 Claims, 1 Drawing Sheet

SILVER REFINING INSTALLATION

The present invention relates to an installation for refining silver operating according to the Moebius process and designed for treating particulate raw silver, the anodes containing a compartment for receiving the raw silver, an underlying compartment for receiving anode sludge, and, positioned between them, a support permeable to anode sludge and designed for supporting the raw silver charge, the support having at least two mutually mobile conveyor elements with horizontal axes, extending substantially over the support width and defining a gap for the passage of anode sludge.

In the Moebius process raw silver is dissolved anodically and deposited cathodically as refined silver. For this purpose plate-like silver anodes were originally surrounded by anode bags and each of them arranged between stripping-off sheet cathodes. The anode bags retain the gold sludge—when an anode has been used up, it is replaced, the gold sludge being rinsed off the anode bags after they have been turned inside out.

In order to provide for continuous operation, Applicant's prior art Austrian Patent 1751/96 (hereinafter A 1751/96) proposes the use of tank-like anode casings having a gold sludge collecting space with a rigid bottom from which the gold sludge can be sucked off during operation. In this, the anode body is a frame-like or basket-like structure of insoluble metal, e.g. of titanium, and is supplied with raw silver granules so that operation may be continuous. A sieve bottom is provided for separating the raw silver charge from the collecting space for anode sludge. This may lead to the problem of passivation of the anode surface, on the one hand, which may be solved by agitating the electrolyte in the anodic charge according to Austrian Patent A 510/97 of Applicant. On the other hand, there may be the problem of clogging of the sieve bottom, even in case of agitation of the electrolyte, as its passage gaps must be narrow enough so as to permit the passage of anode sludge only.

In this context it was found that the raw silver granules remain solid for the most part of the period of silver dissolution and that their size changes very little—the granules become soft only after the silver content has fallen to about 4% (starting at more than 80%). Then the gold content is about 90%. It is supposed that the palladium content is responsible for this strength, which has been enriched to about 6% by this time. Towards the end the granules fall apart almost by themselves, but during the transition from softening to disintegration, there is the so-called mud phase, when there may be the danger of clogging of the sieve bottoms.

According to applicant's A 896/97 it had surprisingly been found that the Moebius electrolysis may be carried out in a way as efficient as never before by very simple agitation of the granule charge in the final phase of electrolysis and a completely new kind of support instead of the sieve bottom.

Accordingly it had been proposed to provide the support for the raw silver charge in the form of at least two cylinders driven in counter-rotation, the axes of which are parallel to each other and which have conveyor elements, in particular axial conveying ribs for conveying anode sludge through the gap between the cylinders and, as the case may be, between one cylinder and an adjacent immobile wall.

The conveyor elements furthermore have the additional highly important function of bringing about complete disintegration of the granules by movement—for this purpose oscillating movement of the cylinders has been preferred, wherein material may remain in the nip while the conveyor elements move away after having conveyed it to the nip. The same is true for the gap between the cylinder and the bottom container wall.

Now it was surprisingly found that, as compared to applicant's A 896/97, a still improved disintegration effect for the granules is achieved if the conveyor elements are not swivelled with regard to each other, but if moved back and forth in the direction of their axes.

Accordingly, an installation of the kind initially defined, namely where the support comprises at least two conveyor elements being moveable with regard to each other and each having a horizontal axis, said elements substantially extending over the width of the support and defining between them a gap for the passage of anode sludge, is primarily characterised in that said conveyor elements are movable back and forth in axial direction. Thereby, their surfaces contacted by the granular charge are displaced with regard to said charge and provide for the necessary abrasion.

Preferred conveyor elements are straight prisms having triangular or rectangular cross sections and being arranged with the gap between two of their edges so that abraded matter is directed to the gap by converging surfaces.

Its is furthermore advantageous to use straight cylinders as conveyor elements, said cylinders having preferably at least substantially smooth surfaces and their cross-sections possibly differing from a circle. Its is contemplated to also make use of the inventive idea of applicant's A 896/97, namely to also swivel said cylinders in case a more complicated driving mechanism is tolerated. Then after a swivelling stroke conveying material to the gap, several back-and-forth strokes of the conveyor cylinders in axial direction may be provided.

BRIEF DESCRIPTION OF DRAWINGS

In the following, the invention will be closer explained by means of an example and by reference to the drawings, wherein.

DETAILED DESCRIPTION OF THE PREFERRED EMBODIMENT

Figure 3:
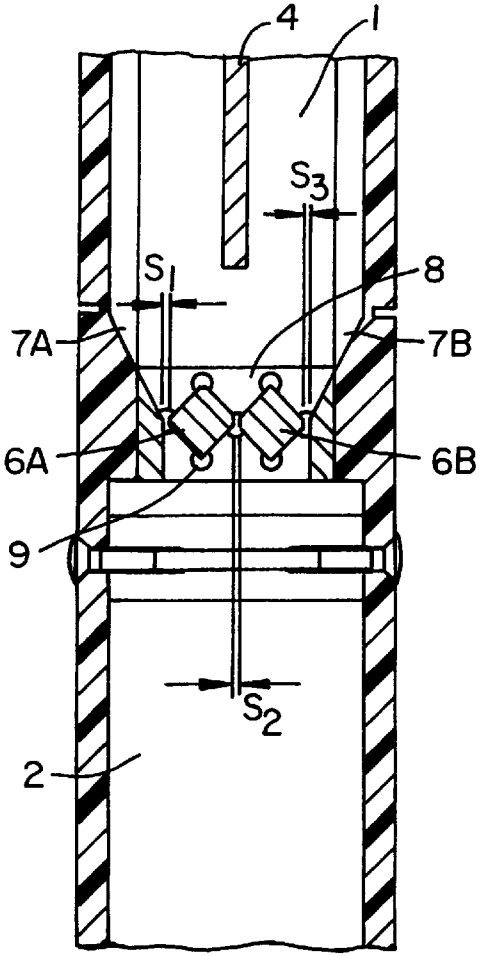
FIG. 3 is an enlarged fractional view from FIG. 2.
Figure 2:
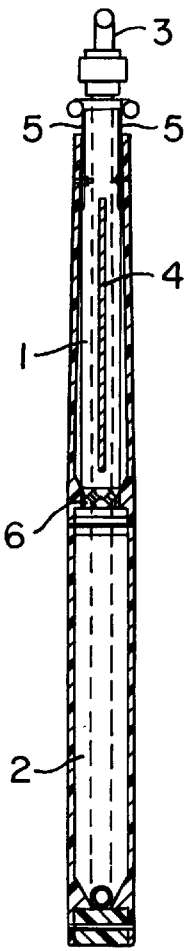
FIG. 1 is a cross-sectional front view and FIG. 2 is a cross-sectional side view of a basket anode that is charged with a raw silver charge, covered by an electrolysis bag and hung between stripping-off cathodes.
Figure 1:
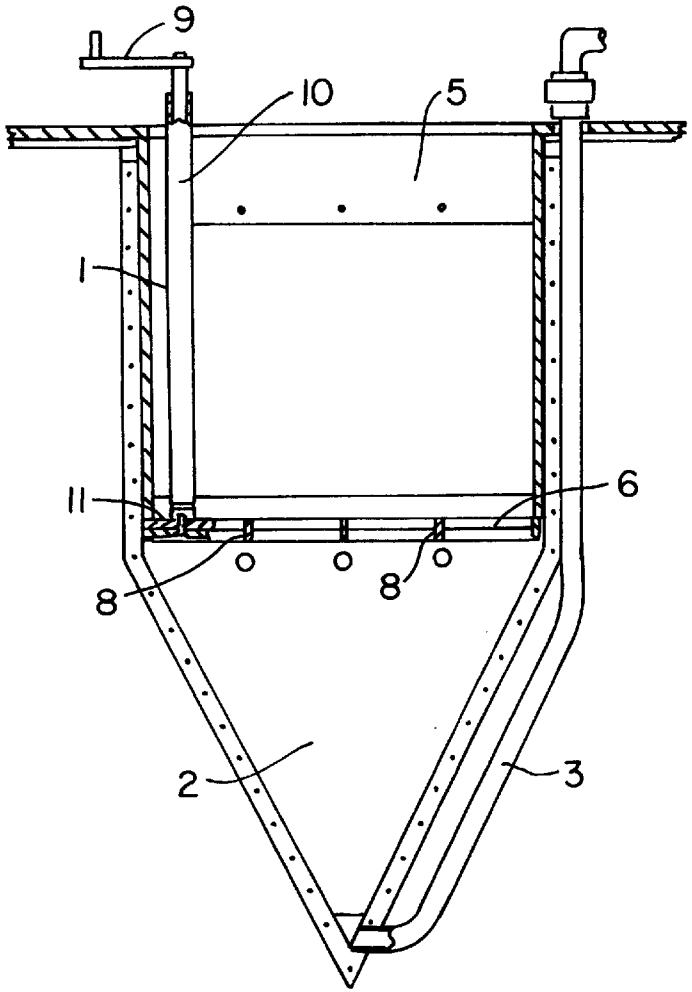

In a manner known per se the anode is a flat structure having an upper compartment 1 for receiving the granular charge and a lower wedge-shaped compartment 2 for collecting anode sludge and being equipped with a suction pipe 3 for sludge removal.

The compartment 1 for receiving the granular charge is equipped with a central porous partition wall 4 and with a metallic contact plate 5 on each side of said wall 4. In a manner known per se, said structure is provided for transversal permeation of the anode basket with electrolyte by passages in the side walls and diaphragms between the granular charge and the side walls (not shown in the drawings).

Between compartment 1 for receiving the granular charge and compartment 2 for collecting anode sludge a mechanically operating granule disintegrating device is provided, extending below the granular charge and substantially along its entire width, bearing the general numeral 6 and being closer detailed in FIG. 3.

Said granule disintegrating device 6 comprises two straight prism rods 6A, 6B running parallely to each other and having square cross-sections, said prism rods having one edge adjacent to an edge of the neighbouring rod and the opposite edge adjacent to a neighbouring side wall of compartment 1, the lower parts 7A, 78 of said side walls converging in the direction towards said prism rods. In this way a gap 51 is provided between sidewall 7A and prism rod 6A, a gap 52 is provided between the prism rods 6A and 6B, and a gap S3 is provided between prism rod 6B and side wall 7B, and these gaps preferably have equal widths. The actual gap width will depend on the running parameters of the installation and even on the size and composition of the raw silver granules—as a rule, said widths may vary between about 0,5 mm and about 5 mm, preferably between 1 and 2 mm.

The prism rods 6A, 6B are slidably held by support walls 8 that at the positions where they are penetrated by the edges of the rods are provided with relief bores 9 allowing solids to be transversely removed from said walls when the prism rods are displaced parallely with regard to each other.

Regarding said displacement of the prism rods 6A, 6B relative to each other and relative to the converging parts 7A, 7B of the side walls, the drawings schematically disclose a swivel lever 9 interacting with the prism rods 6A, 6B via a connector axis 10 and cams 11 and—upon its swivel movement—brings about the disintegration of the residues of the granules in the three gaps already described.

The converging parts 7A, 7B of the side walls and the shape of the prism rods 6A, 6B provide for directing the granules to said gaps, thereby avoiding surfaces where matter from said granules could accumulate, and hence avoiding the danger of clogging. The invention has been described in terms of what is considered the preferred embodiment but it is understood that said embodiment is intended to cover various modifications and similar arrangements included with the spirit and scope of the appended claims.

What is claimed is:

1. An installation for silver refining according to the Moebius process using raw silver granules, the anodes containing a compartment for receiving the raw silver, an underlying compartment for receiving anode sludge, and, positioned between them, a support permeable to anode sludge and designed for supporting the raw silver charge, the support having at least two mutually mobile conveyor elements with horizontal axes, extending substantially over the support width and defining a gap for the passage of anode sludge, characterised in that said conveyor elements are provided for axial back-and-forth movement.

2. An installation according to claim 1, characterised in that the conveyor elements are straight prisms having at least triangular cross-sections.

3. An installation according to claim 2, characterised in that the gap between two prisms is provided between two longitudinal edges of said prisms.

4. An installation according to claim 1, characterised in that the conveyor elements are straight cylinders having at least substantially smooth surfaces and their cross-sections possibly differing from a circle.

5. An installation according to claim 2, characterised in that the conveyor elements are additionally provided for counter-rotative swivelling about their axes.

6. An installation according to claim 5, characterised in that the conveyor elements are provided for both alternating back-and-forth movement and swivelling movement, wherein preferably several back-and-forth strokes are provided per swivelling stroke.

* * * * *